US006344275B2

(12) United States Patent
Katsumura et al.

(10) Patent No.: US 6,344,275 B2
(45) Date of Patent: Feb. 5, 2002

(54) ELECTRODE MATERIAL FOR FORMING STAMPER AND THIN FILM FOR FORMING STAMPER

(75) Inventors: Masahiro Katsumura; Tetsuya Iida, both of Tsurugashima; Takashi Ueno, Tokyo-to, all of (JP)

(73) Assignees: Pioneer Corporation; Furuya Metal Co., Ltd., both of Tokyo-To (JP)

( * ) Notice: Subject to any disclaimer, the term of this patent is extended or adjusted under 35 U.S.C. 154(b) by 0 days.

(21) Appl. No.: 09/853,677

(22) Filed: May 14, 2001

(30) Foreign Application Priority Data

May 12, 2000 (JP) ..... 2000-139384

(51) Int. Cl.[7] ..... B32B 15/04; B32B 17/06

(52) U.S. Cl. ..... 428/432; 428/433; 428/434; 428/630; 428/680

(58) Field of Search ..... 428/432, 433, 428/434, 630, 680

(56) References Cited

U.S. PATENT DOCUMENTS 5,756,130 A * 5/1998 Umebayashi et al. ..... 425/385
5,851,251 A * 12/1998 Kondo et al. ..... 65/23

* cited by examiner

*Primary Examiner*—Deborah Jones
*Assistant Examiner*—Andrew T. Piziali
(74) *Attorney, Agent, or Firm*—Sughrue Mion, PLLC

(57) ABSTRACT

To present a material for stamper free from deterioration of stamper quality due to reaction with an electron-attracting radical contained in the resist material. An electrode formed on the surface of a patterned resist film 2 for electrocasting a stamper material is formed of a nickel alloy thin film 3 comprising Ni element as a principal component, and Ru element added in a range of less than 25 percent by weight.

18 Claims, 7 Drawing Sheets

FIG.4

| MATERIAL | IMMERSION RESULT IN NaCl AQUEOUS SOLUTION | RESULT OF HIGH TEMPERATURE AND HUMIDITY RESISTANCE ACCELERATION TEST |
|---|---|---|
| PURE Ni | DARKENING OF END PORTION (BY CHLORINATION REACTION) | END PORTION DARKENING AND PEELING |
| Ni−1wt%Ru | NO CHANGE | NO CHANGE |
| Ni−5wt%Ru | NO CHANGE | NO CHANGE |
| Ni−10wt%Ru | NO CHANGE | NO CHANGE |
| Ni−20wt%Ru | NO CHANGE | SLIGHT DARKENING OF END PORTION |
| Ni−25wt%Ru | SLIGHT DARKENING OF END PORTION | SLIGHT DARKENING OF END PORTION |
| Ni−1wt%Cu | NO CHANGE | NO CHANGE |
| Ni−5wt%Cu | NO CHANGE | NO CHANGE |
| Ni−10wt%Cu | NO CHANGE | NO CHANGE |
| Ni−20wt%Cu | NO CHANGE | SLIGHT DARKENING OF END PORTION |
| Ni−25wt%Cu | SLIGHT DARKENING OF END PORTION | SLIGHT DARKENING OF END PORTION |
| Ni−1wt%Ti | NO CHANGE | NO CHANGE |
| Ni−5wt%Ti | NO CHANGE | NO CHANGE |
| Ni−10wt%Ti | NO CHANGE | NO CHANGE |
| Ni−20wt%Ti | NO CHANGE | NO CHANGE |
| Ni−25wt%Ti | NO CHANGE | NO CHANGE |
| Ni−1wt%Ag | NO CHANGE | NO CHANGE |
| Ni−5wt%Ag | NO CHANGE | NO CHANGE |
| Ni−10wt%Ag | NO CHANGE | NO CHANGE |
| Ni−20wt%Ag | NO CHANGE | NO CHANGE |
| Ni−25wt%Ag | NO CHANGE | NO CHANGE |
| Ni−1wt%P | NO CHANGE | NO CHANGE |
| Ni−5wt%P | NO CHANGE | NO CHANGE |
| Ni−10wt%P | NO CHANGE | NO CHANGE |
| Ni−20wt%P | NO CHANGE | SLIGHT DARKENING OF END PORTION |
| Ni−25wt%P | NO CHANGE | SLIGHT DARKENING OF END PORTION |

FIG.5

| MATERIAL | IMMERSION RESULT IN NaCl AQUEOUS SOLUTION | RESULT OF HIGH TEMPERATURE AND HUMIDITY RESISTANCE ACCELERATION TEST |
|---|---|---|
| Ni-1wt%Mg | NO CHANGE | NO CHANGE |
| Ni-5wt%Mg | NO CHANGE | NO CHANGE |
| Ni-10wt%Mg | NO CHANGE | NO CHANGE |
| Ni-20wt%Mg | NO CHANGE | NO CHANGE |
| Ni-25wt%Mg | SLIGHT DARKENING OF END PORTION | NO CHANGE |
| Ni-1wt%Cr | NO CHANGE | NO CHANGE |
| Ni-5wt%Cr | NO CHANGE | NO CHANGE |
| Ni-10wt%Cr | NO CHANGE | NO CHANGE |
| Ni-20wt%Cr | NO CHANGE | NO CHANGE |
| Ni-25wt%Cr | SLIGHT DARKENING OF END PORTION | SLIGHT DARKENING OF END PORTION |
| Ni-1wt%Au | NO CHANGE | NO CHANGE |
| Ni-5wt%Au | NO CHANGE | NO CHANGE |
| Ni-10wt%Au | NO CHANGE | NO CHANGE |
| Ni-20wt%Au | NO CHANGE | NO CHANGE |
| Ni-25wt%Au | SLIGHT DARKENING OF END PORTION | NO CHANGE |
| Ni-1wt%Si | NO CHANGE | NO CHANGE |
| Ni-5wt%Si | NO CHANGE | NO CHANGE |
| Ni-10wt%Si | NO CHANGE | NO CHANGE |
| Ni-20wt%Si | NO CHANGE | NO CHANGE |
| Ni-25wt%Si | SLIGHT DARKENING OF END PORTION | SLIGHT DARKENING OF END PORTION |

| ELECTRODE MATERIAL | PURE Ni | Ni-5wt%Ru |
|---|---|---|
| DISK NOISE [dB] | −74. 3 | −79. 7 |

ELECTRODE MATERIAL FOR FORMING STAMPER AND THIN FILM FOR FORMING STAMPER

BACKGROUND OF THE INVENTION

1. Field of the Invention

The present invention relates to a thin film for forming stamper used as an electrode formed on the surface of a patterned resist material for electrocasting a stamper material, and an electrode material for forming stamper used as the material of such an electrode.

2. Description of the Related Art

Optical disks such as CD and DVD are mass-produced by using a mother disk called stamper. FIG. 8 shows a conventional stamper manufacturing method. First, as shown in FIG. 8A, a photoresist film 102 is formed on a glass substrate 101 by spin coating or other process, and then, as shown in FIG. 8B, the photoresist film 102 is exposed by laser beam and a latent image 102*a* is formed. The photoresist film 102 is developed, and a pattern having a groove 102*b* as shown in FIG. 8C is formed. Then, as shown in FIG. 8D, a nickel thin film 103 is formed on the surface of the photoresist film 102 and glass substrate 101 by sputtering, vapor deposition or other method. Next, as shown in FIG. 8E, using the nickel thin film 103 as electrode, nickel electrocasting is applied on the surface of the nickel thin film 103, and a nickel layer 104 is formed. As shown in FIG. 8F, the nickel layer 104 is separated from the glass substrate 101, and, for example, the top surface of the nickel layer 104 in FIG. 8F is polished, and a stamper 104A is obtained.

A further higher recording density is required in optical disks. To meet the demand of high recording density for assuring a storage capacity of over tens of GB in a disk of 12 cm in diameter expected in future, the conventional laser beam cutting using laser beam is not applicable, and electron beam cutting using electron beam is noticed as a method replacing the laser beam cutting. According to the electron beam cutting, as compared with the conventional laser beam cutting, a pattern of higher definition can be formed.

For electron beam cutting, however, the electron absorption sensitivity of the resist material must be improved, and an electron-attracting radical such as chlorine, sulfur or fluorine is added to the resist material. But in the process of nickel electrocasting, the electron-attracting radical in the resist material and the nickel thin film react with each other, and the nickel thin film is damaged, and the quality of the stamper deteriorates.

It is hence an object of the invention to present a thin film for forming stamper not deteriorating the quality of stamper by reaction with the electron-attracting radical contained in the resist material, and an electrode material for forming stamper used as the material of such an electrode.

SUMMARY OF THE INVENTION

The electrode material for forming stamper of the invention is an electrode material for forming stamper used as a material of an electrode formed on the surface of a patterned resist material for electrocasting a stamper material, in which Ni element is a principal component, and Ru element is added in a range of less than 25 percent by weight.

According to this electrode material for forming stamper, since reaction between Ni in the electrode material and the electron-attracting radical contained in the resist material is suppressed, deterioration of stamper quality can be prevented. Further, the electrode excellent in flatness is formed, so that the S/N ratio of the optical disk may be enhanced.

The electrode material for forming stamper of the invention is an electrode material for forming stamper used as a material of an electrode formed on the surface of a patterned resist material for electrocasting a stamper material, in which Ni element is a principal component, and Cu element is added in a range of less than 25 percent by weight.

According to this electrode material for forming stamper, since reaction between Ni in the electrode material and the electron-attracting radical contained in the resist material is suppressed, deterioration of stamper quality can be prevented.

The electrode material for forming stamper of the invention is an electrode material for forming stamper used as a material of an electrode formed on the surface of a patterned resist material for electrocasting a stamper material, in which Ni element is a principal component, and P element is added in a range of less than 25 percent by weight.

According to this electrode material for forming stamper, since reaction between Ni in the electrode material and the electron-attracting radical contained in the resist material is suppressed, deterioration of stamper quality can be prevented.

The electrode material for forming stamper of the invention is an electrode material for forming stamper used as a material of an electrode formed on the surface of a patterned resist material for electrocasting a stamper material, in which Ni element is a principal component, and Mg element is added in a range of less than 25 percent by weight.

According to this electrode material for forming stamper, since reaction between Ni in the electrode material and the electron-attracting radical contained in the resist material is suppressed, deterioration of stamper quality can be prevented.

The electrode material for forming stamper of the invention is an electrode material for forming stamper used as a material of an electrode formed on the surface of a patterned resist material for electrocasting a stamper material, in which Ni element is a principal component, and Cr element is added in a range of less than 25 percent by weight.

According to this electrode material for forming stamper, since reaction between Ni in the electrode material and the electron-attracting radical contained in the resist material is suppressed, deterioration of stamper quality can be prevented. Further, the electrode excellent in flatness is formed, so that the S/N ratio of the optical disk may be enhanced.

The electrode material for forming stamper of the invention is an electrode material for forming stamper used as a material of an electrode formed on the surface of a patterned resist material for electrocasting a stamper material, in which Ni element is a principal component, and Au element is added in a range of less than 25 percent by weight.

According to this electrode material for forming stamper, since reaction between Ni in the electrode material and the electron-attracting radical contained in the resist material is suppressed, deterioration of stamper quality can be prevented.

The electrode material for forming stamper of the invention is an electrode material for forming stamper used as a material of an electrode formed on the surface of a patterned resist material for electrocasting a stamper material, in which Ni element is a principal component, and Si element is added in a range of less than 25 percent by weight.

According to this electrode material for forming stamper, since reaction between Ni in the electrode material and the electron-attracting radical contained in the resist material is suppressed, deterioration of stamper quality can be prevented.

The electrode material for forming stamper of the invention is an electrode material for forming stamper used as a material of an electrode formed on the surface of a patterned resist material for electrocasting a stamper material, in which Ni element is a principal component, and Ti element is added in a range of less than 50 percent by weight.

According to this electrode material for forming stamper, since reaction between Ni in the electrode material and the electron-attracting radical contained in the resist material is suppressed, deterioration of stamper quality can be prevented.

The material for forming stamper of the invention is an electrode material for forming stamper used as a material of an electrode formed on the surface of a patterned resist material for electrocasting a stamper material, in which Ni element is a principal component, and Ag element is added in a range of less than 50 percent by weight.

According to this electrode material for forming stamper, since reaction between Ni in the electrode material and the electron-attracting radical contained in the resist material is suppressed, deterioration of stamper quality can be prevented. Further, the electrode excellent in flatness is formed, so that the S/N ratio of the optical disk may be enhanced.

The thin film for forming stamper of the invention is a thin film for forming stamper used as an electrode formed on the surface of a patterned resist material for electrocasting a stamper material, in which Ni element is a principal component, and Ru element is added in a range of less than 25 percent by weight.

According to this thin film for forming stamper, since reaction between Ni in the electrode material and the electron-attracting radical contained in the resist material is suppressed, deterioration of stamper quality can be prevented. Further, the electrode excellent in flatness is formed, so that the S/N ratio of the optical disk may be enhanced.

The thin film for forming stamper of the invention is a thin film for forming stamper used as an electrode formed on the surface of a patterned resist material for electrocasting a stamper material, in which Ni element is a principal component, and Cu element is added in a range of less than 25 percent by weight.

According to this thin film for forming stamper, since reaction between Ni in the electrode material and the electron-attracting radical contained in the resist material is suppressed, deterioration of stamper quality can be prevented.

The thin film for forming stamper of the invention is a thin film for forming stamper used as an electrode formed on the surface of a patterned resist material for electrocasting a stamper material, in which Ni element is a principal component, and P element is added in a range of less than 25 percent by weight.

According to this thin film for forming stamper, since reaction between Ni in the electrode material and the electron-attracting radical contained in the resist material is suppressed, deterioration of stamper quality can be prevented.

The thin film for forming stamper of the invention is a thin film for forming stamper used as an electrode formed on the surface of a patterned resist material for electrocasting a stamper material, in which Ni element is a principal component, and Mg element is added in a range of less than 25 percent by weight.

According to this thin film for forming stamper, since reaction between Ni in the electrode material and the electron-attracting radical contained in the resist material is suppressed, deterioration of stamper quality can be prevented.

The thin film for forming stamper of the invention is a thin film for forming stamper used as an electrode formed on the surface of a patterned resist material for electrocasting a stamper material, in which Ni element is a principal component, and Cr element is added in a range of less than 25 percent by weight.

According to this thin film for forming stamper, since reaction between Ni in the electrode material and the electron-attracting radical contained in the resist material is suppressed, deterioration of stamper quality can be prevented. Further, the electrode excellent in flatness is formed, so that the S/N ratio of the optical disk may be enhanced.

The thin film for forming stamper of the invention is a thin film for forming stamper used as an electrode formed on the surface of a patterned resist material for electrocasting a stamper material, in which Ni element is a principal component, and Au element is added in a range of less than 25 percent by weight.

According to this thin film for forming stamper, since reaction between Ni in the electrode material and the electron-attracting radical contained in the resist material is suppressed, deterioration of stamper quality can be prevented.

The thin film for forming stamper of the invention is a thin film for forming stamper used as an electrode formed on the surface of a patterned resist material for electrocasting a stamper material, in which Ni element is a principal component, and Si element is added in a range of less than 25 percent by weight.

According to this thin film for forming stamper, since reaction between Ni in the electrode material and the electron-attracting radical contained in the resist material is suppressed, deterioration of stamper quality can be prevented.

The thin film for forming stamper of the invention is a thin film for forming stamper used as an electrode formed on the surface of a patterned resist material for electrocasting a stamper material, in which Ni element is a principal component, and Ti element is added in a range of less than 50 percent by weight.

According to this thin film for forming stamper, since reaction between Ni in the electrode material and the electron-attracting radical contained in the resist material is suppressed, deterioration of stamper quality can be prevented.

The thin film for forming stamper of the invention is a thin film for forming stamper used as an electrode formed on the surface of a patterned resist material for electrocasting a stamper material, in which Ni element is a principal component, and Ag element is added in a range of less than 50 percent by weight.

According to this thin film for forming stamper, since reaction between Ni in the electrode material and the electron-attracting radical contained in the resist material is suppressed, deterioration of stamper quality can be prevented. Further, the electrode excellent in flatness is formed, so that the S/N ratio of the optical disk may be enhanced.

For the ease of understanding of the invention, reference numerals in the accompanying drawings are enclosed in parentheses, but it must be noted that the invention is not limited to the illustrated embodiments alone.

BRIEF DESCRIPTION OF THE DRAWINGS

FIGS. 1A to 1F are diagrams showing a process of manufacturing a stamper for manufacturing an optical disk by using a thin film for forming the stamper, in which FIG. 1A is a sectional view showing a state of applying the resist, FIG. 1B is a sectional view showing a state of forming a latent image, FIG. 1C is a sectional view showing a state after development, FIG. 1D is a sectional view showing a state after forming a nickel alloy thin film, FIG. 1E is a sectional view showing a state of forming a nickel layer, and FIG. 1F is a sectional view showing the stamper.

FIG. 4 is a diagram showing results of resistance and high temperature and humidity resistance acceleration tests of pure Ni thin film and Ni alloy thin film in sodium chloride aqueous solution.

FIG. 5 is a diagram showing results of resistance and high temperature and humidity resistance acceleration tests of Ni alloy thin film in sodium chloride aqueous solution.

FIGS. 8A to 8F are diagrams showing a conventional process of manufacturing a stamper for manufacturing an optical disk by using a thin film for forming the stamper, in which FIG. 8A is a sectional view showing a state of applying the resist, FIG. 8B is a sectional view showing a state of forming a latent image, FIG. 8C is a sectional view showing a state after development, FIG. 8D is a sectional view showing a state after forming a nickel alloy thin film, FIG. 8E is a sectional view showing a state of forming a nickel layer, and FIG. 8F is a sectional view showing the stamper.

DESCRIPTION OF THE PREFERRED EMBODIMENTS

Figure 1A:
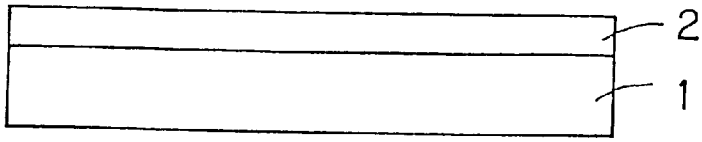
Figure 1B:
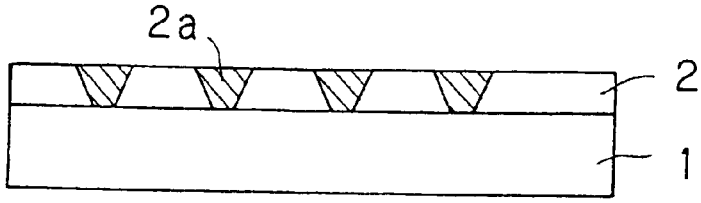
Figure 1C:
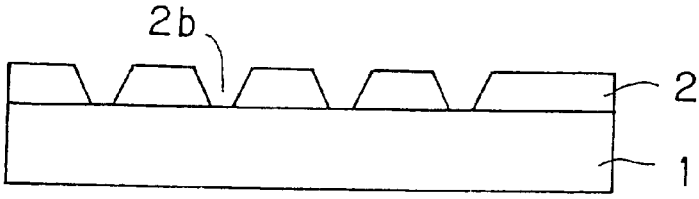
Figure 1D:
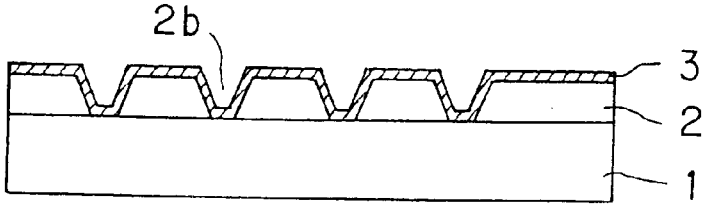
Figure 1E:
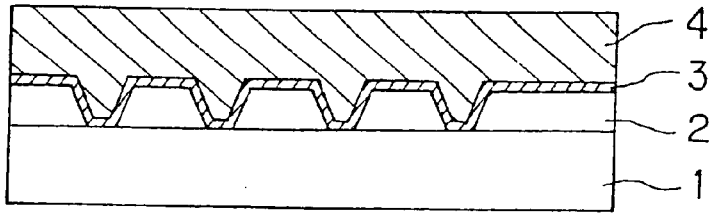
Figure 1F:
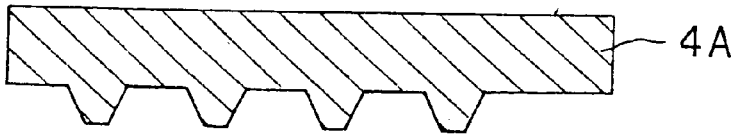
Figure 2:
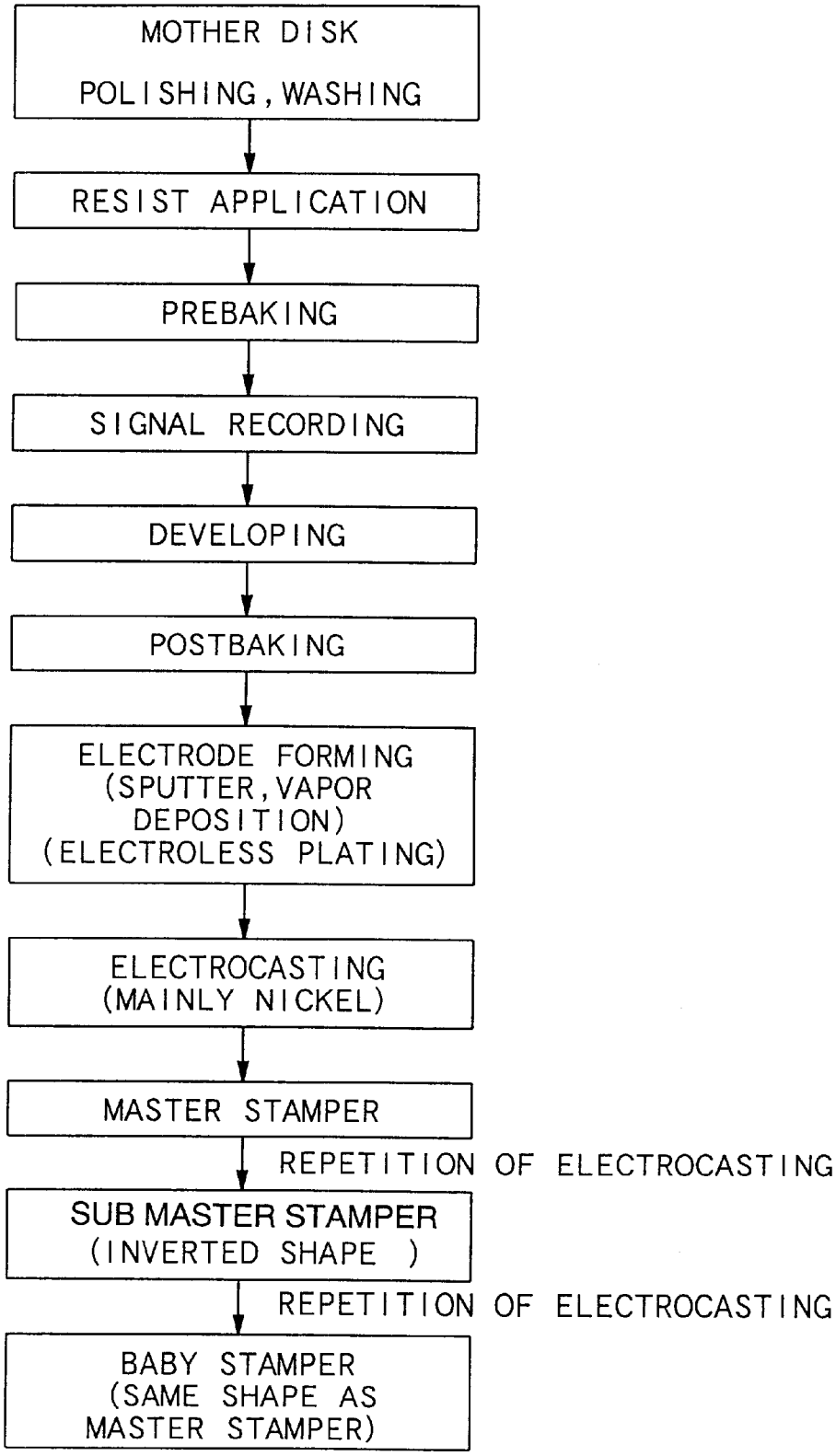
FIG. 2 is a diagram showing the detail of a process of manufacturing a stamper for manufacturing an optical disk by using a thin film for forming the stamper.

Referring to FIG. 1A to FIG. 7, a preferred embodiment of thin film for forming stamper of the invention is described below. FIGS. 1A to 1F are sectional views showing a process of manufacturing a stamper for manufacturing an optical disk by using a thin film for forming the stamper of the embodiment, and FIG. 2 shows the detail of the process.

First, as shown in FIG. 1A and FIG. 2, a glass substrate 1 is polished and washed, and an electron beam resist film 2 for electron beam is formed on the glass substrate 1 by spin coating or other method. The electron beam resist film 2 is prebaked, and the electron beam resist film 2 is exposed by an electron beam as shown in FIG. 1B, so that a latent image 2*a* is formed ("signal recording" in FIG. 2). The electron beam resist film 2 is developed, a groove 2*b* as shown in FIG. 1C is formed, and the electron beam resist film 2 is postbaked.

As shown in FIG. 1D, consequently, a nickel alloy thin film 3 is formed on the surface of the electron beam resist film 2 and glass substrate 1 by sputtering, vapor deposition, or electroless plating. The material of the nickel alloy thin film is described later.

Using the nickel alloy thin film 3 as electrode, as shown in FIG. 1E, nickel electrocasting is applied on the surface of the nickel alloy thin film 3, and a nickel layer 4 is formed. As shown in FIG. 1F, the nickel layer 4 is separated from the glass substrate 1, and, for example, the top surface of the nickel layer 4 in FIG. 1F is polished, and a master stamper 4A is obtained. Incidentally, instead of the nickel layer 4, a nickel alloy layer may be formed by electrocasting, and the separated nickel alloy layer may be used as stamper.

As shown in FIG. 2, by applying nickel again on the master stamper 4A by electrocasting, a sub stamper of an inverted shape is obtained. Further, by applying nickel on the sub stamper by electrocasting, a baby stamper of a same shape as master stamper is obtained.

Figure 3:
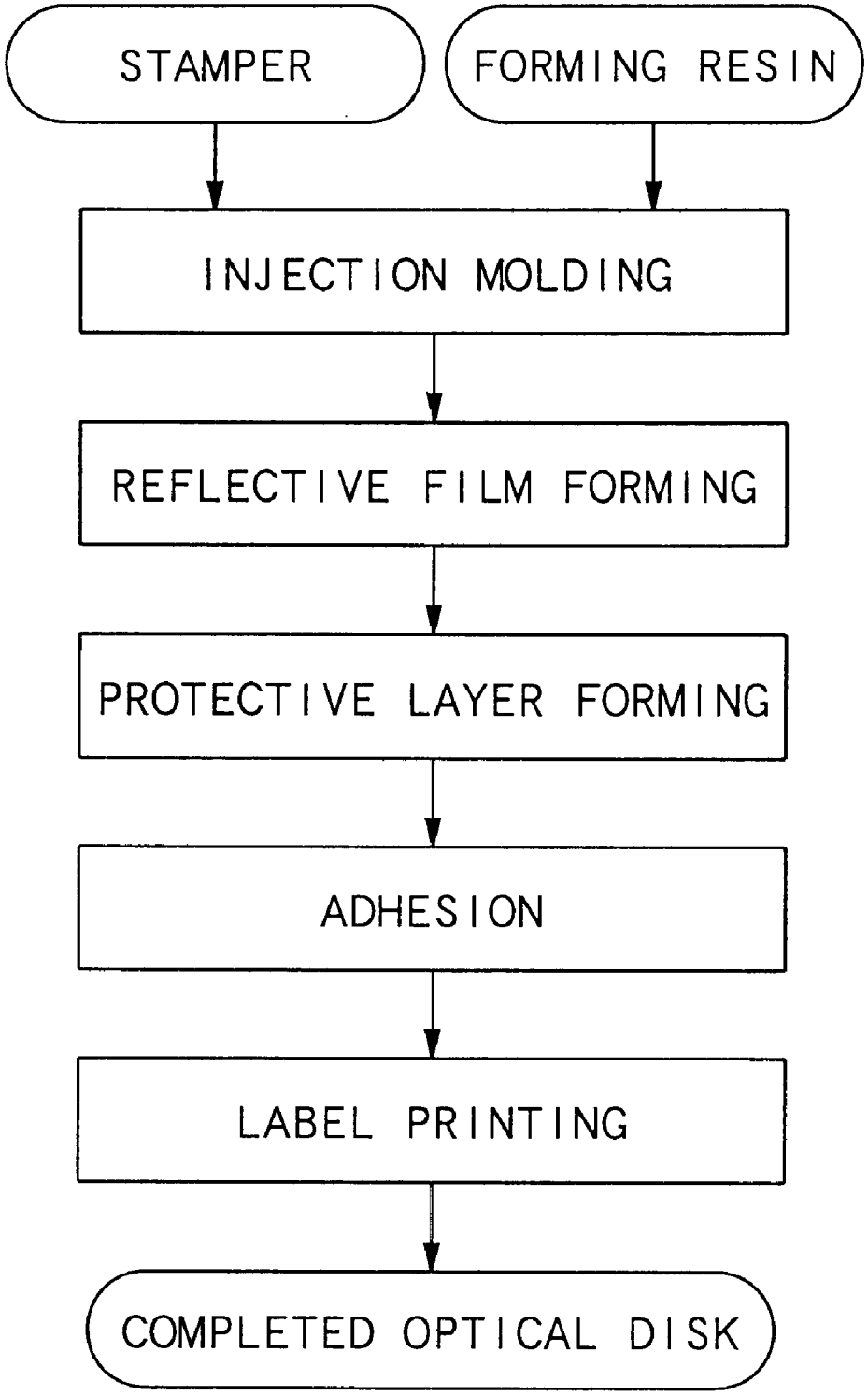
FIG. 3 is a diagram showing a process of manufacturing an optical disk by using a stamper for manufacturing the optical disk.

FIG. 3 shows a process of manufacturing an optical disk by using a master stamper 4A or baby stamper. As shown in FIG. 3, after injection molding by using the stamper, a reflective film and a protective film are formed, and an optical disk is manufactured. The process in FIG. 3 is same as an ordinary manufacturing process, and detailed description is omitted.

The material of the nickel alloy thin film 3 is a nickel alloy comprising Ni element as a principal component, and at least one of elements Ru, Cu, P, Mg, Cr, Au, Si, Ti, and Ag added in a range of less than 50 percent by weight. In the embodiment, by forming the nickel alloy thin film 3 by using the Ni alloy containing at least one of the above elements, damage of the nickel alloy thin film 3 at the time of forming the nickel layer 4 by electrocasting can be prevented.

In the material of the nickel alloy thin film 3, at least one of the elements P, Mg, Si is added, and when the content of these elements is less than 25 percent by weight, these elements do not react with the principal component of Ni unless heated at least to about 400 to 500° C. Accordingly, in a thin film state, P, Mg, or Si deposits on the grain boundary of Ni, and is bonded with oxygen to be oxidized in other environment than inert atmosphere. In this case, in a state of an alloy thin film mainly composed of Ni, the oxide film of the added P, Mg, or Si deposits not only on the Ni grain boundary, but also on the thin film surface. As a result, the surface oxide film depositing on the thin film surface becomes a non-conductor to act as a barrier material for reaction between incoming active metal or non-metallic element and Ni, and it has been confirmed that the weather resistance of the Ni alloy is enhanced. However, the additive element such as P, Mg, or Si is likely to be bonded with oxygen, and also with other active non-metallic element, and therefore if added in excess, the weather resistance is lowered to the contrary. It hence seems to be proper by adding in a range of less than 25 percent by weight.

Similarly when adding Ti to the principal component Ni, except when also forming a compound by reaction while heating in high temperature atmosphere, Ti deposits on the Ni grain boundary. Such Ni alloy with Ti does not form non-conductor, but since Ti is stable in chlorine, it is effective to suppress exudation of active element into Ni grains or chemical reaction, and it seems to prevent chemical reaction on Ni grains.

When Cu or Au is added to Ni, a stable and complete solid solution is confirmed. In this case, both additive elements Cu and Au are excellent in chlorine resistance, and are atomically bonded with Ni in solid solution, thereby forming a distortion in the Ni crystal structure of the principal component. In this Ni solid solution alloy, since the bonding property with chlorine is lessened depending on the additive element, it is not always stable in the presence of chlorine in any circumstance, but the chemical reactivity to chlorine is lowered. According to an experiment, chlorination was not formed in such solid solution.

Further, by adding Ru, Ag, or Cr to Ni, a solid solution is formed at a specific content, at least at less than 10 percent by weight, and a same solid solution as when adding Cu or Au has been confirmed. When Ru, Ag, or Cr is added by more than 10 percent by weight, exceeding the solid solution limit, the whole added content is not dissolved, but Ru, Ag, or Cr deposits on the grain boundary of solid solution. However, in this case, too, the resistance to chlorination is enhanced as compared with that of pure Ni.

Moreover, the alloy thin film of Ni with at least one of Ru, Ag, and Cr is not only improved in chlorination resistance, but also enhanced in flatness of thin film. The flatness of thin film has been confirmed in the signal characteristic in reproduction of an optical disk manufactured by using the stamper formed by using this alloy thin film. When the added Ru, Ag, or Cr is solidified to form a solid solution, it has been confirmed that the crystal structure of the principal component Ni is distorted to micronize thin film particles. Further, in the Ni alloy composed of a composition exceeding the solid solution limit, there is a possibility of suppression of growth of Ni solid solution alloy grains, and the non-solidified additive content of the additive element existing in the grain boundary may be considered to be effective to promote stress relaxation.

The compositions of nickel alloy described in the embodiment are excellent in ductility and processability same as pure Ni, and also have chlorination resistance and bromination resistance, and are hence applicable to uses and application technologies hitherto limited because of the nature of pure Ni likely to react with chlorine or bromine.

EXAMPLES

Preparing Ni and sputtering targets of additive metals Ru, Cu, P, Mg, Cr, Au, Si, Ti, and Ag, the sputtering target of specified element and Ni were put in an RF magnetron sputtering apparatus, and a thin film was formed on a quartz substrate. The sputtering target was 3 inches (7.62 cm) in diameter, and 5 mm in thickness, and the distance from the sputtering target to the substrate was about 90 mm. While controlling the discharge amount of metal atoms by RF feed power to Ni and sputtering target of specified element, two metals were stacked up on the substrate simultaneously. As the film forming condition, the final degree of vacuum is $3\times10^{-5}$ Pa and the gas pressure when forming film is 0.7 to 1 Pa. The RF feed power was varied in a range of 100 to 500 W depending on the composition of the alloy. Thus, thin films of Ni—Ru alloy, Ni—Cu alloy, Ni—P alloy, Ni—Mg alloy, Ni—Cr alloy, Ni—Au alloy, Ni—Si alloy, Ni—Ti alloy, and Ni-Ag alloy were formed on substrates. In each alloy, the content of Ru, Cu, P, Mg, Cr, Au, Si, Ti, and Ag was varied in five concentrations, 1, 5, 10, 20, and 25 percent by weight. By way of reference, a pure Ni thin film was formed on the substrate by using the same apparatus (see FIG. 4 and FIG. 5).

The quartz substrates having the thin films stacked up thereon by the above method were immersed in sodium chloride aqueous solution and let stand for a specified time, and observed changes with time are shown in FIG. 4 and FIG. 5. The sodium chloride contained in the sodium chloride aqueous solution is 5 percent by volume, and the quartz substrates were immersed in the aqueous solution for about 96 hours at ordinary temperature without heating. After standing for 96 hours, changes with time of the thin film were visually observed, and the optical characteristics such as reflectivity of thin film were inspected by spectrophotometer, and changes of surface state of thin films were evaluated.

As a result, when the pure Ni thin film was immersed in the sodium chloride aqueous solution, the end portion was darkened due to chlorination reaction. Besides, as a result of high temperature and humidity resistance acceleration test, aside from darkening of the end portion, peeling of the thin film was recognized.

By contrast, in Ni—Ru alloy, Ni—Cu alloy, Ni—P alloy, Ni—Mg alloy, Ni—Cr alloy, Ni—Au alloy, Ni—Si alloy, Ni—Ti alloy, and Ni—Ag alloy, on the whole, the chlorination reaction was suppressed, and changes by high temperature and humidity resistance acceleration test were also controlled. However, in Ni-25 wt. % Ru, Ni-25 wt. % Cu, Ni-25 wt. % Mg, Ni-25 wt. % Cr, Ni-25 wt. % Au, and Ni-25 wt. % Si, as a result of immersion in sodium chloride aqueous solution, a slight darkening in the end portion was noted. No change was observed in other alloy thin films. Further, in Ni-20 wt. % Ru, Ni-25 wt. % Ru, Ni-20 wt. % Cu, Ni-25 wt. % Cu, Ni-20 wt. % P, Ni-25 wt. % P, Ni-25 wt. % Cr, and Ni-25 wt. % Si, as a result of high temperature and humidity resistance acceleration test, a slight darkening in the end portion was noted.

Figures 6, 7:
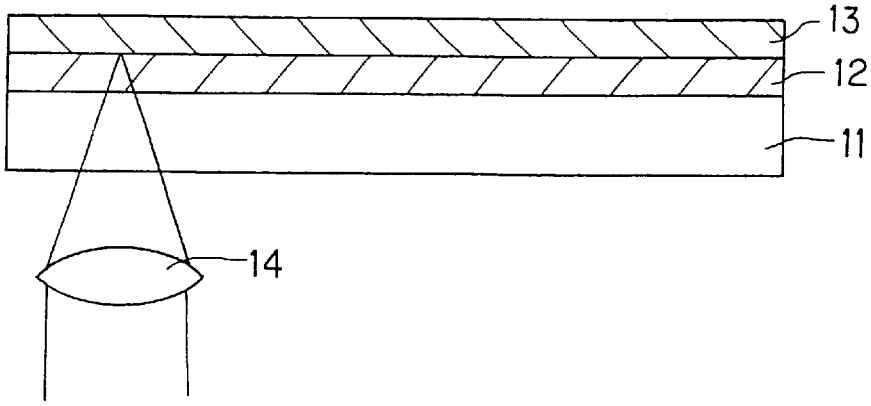
FIG. 6 is a diagram showing a disk noise measuring method by a mirror section reproduced signal of an optical disk.
FIG. 7 is a diagram showing results of measurement of disk noise.
Figure 8A:
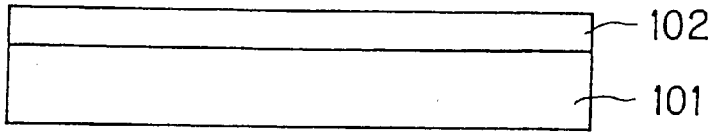
Figure 8B:
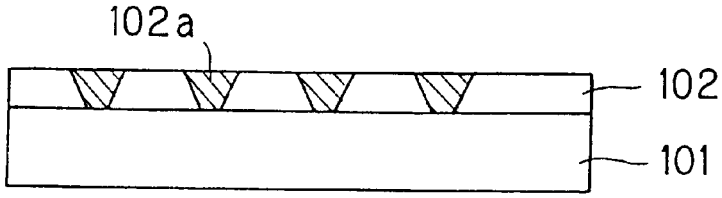
Figure 8C:
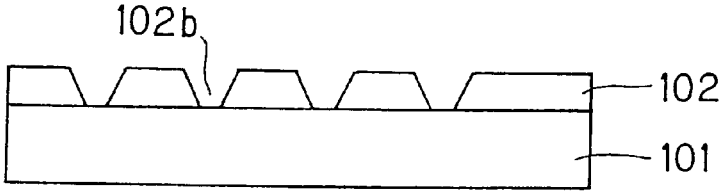
Figure 8D:
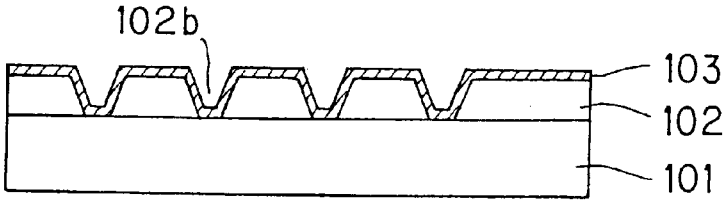
Figure 8E:
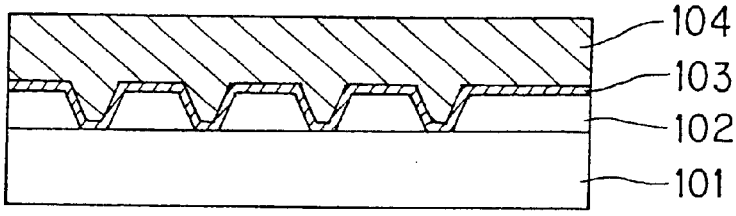
Figure 8F:
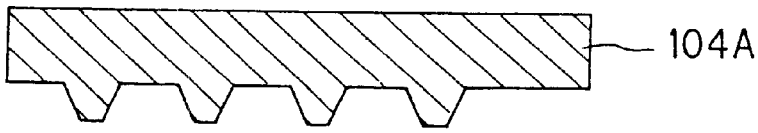

FIG. 6 is a diagram showing a disk noise measuring method by a mirror section reproduced signal of an optical disk, and FIG. 7 is a diagram showing results of measurement. As shown in FIG. 6, a resist layer 12 is formed on a glass substrate 11, and thin films 13 of pure Ni and Ni-5 wt. % Ru are formed thereon as electrode materials, and mother disks for measurement were prepared. As shown in FIG. 7, using the thin film 13 as the reflective layer, the mother disk for measurement was rotated at linear velocity of 3 m/s and irradiated with light beam through a lens 14 from the side of the glass substrate 11, and the reflected light from the interface of the resist layer 12 and thin film 13 was received. Of the reflected light, the level of 1 MHz component was measured as noise component, and the result is shown in FIG. 7. As shown in FIG. 7, the disk noise is −74.3 dB in the case of using pure Ni as the material for the thin film 13, and the disk noise is −79.7 dB in the case of using Ni-5 wt. % Ru as the material for the thin film 13. Therefore, in the case of Ni-5 wt. % Ru, the S/N ratio is improved by more than 5 dB as compared with the case of pure Ni. This result suggests that the flatness of the thin film of Ni-5 wt. % RU is superior to that of pure Ni, showing excellent suitability as the material used in manufacture of optical mother disk.

The entire disclosure of Japanese Patent Application No. 2000-139384 filed on May 12, 2000 including specification, claims, drawings and summary are incorporated herein by reference in its entirety.

What is claimed is:

1. An electrode material for forming stamper used as a material of an electrode formed on the surface of a patterned resisit material for electrocasting a stamper material, wherein Ni element is a principal component, and Ru element is added in a range of less than 25 percent by weight.

2. An electrode material for forming stamper used as a material of an electrode formed on the surface of a patterned resisit material for electrocasting a stamper material, wherein Ni element is a principal component, and Cu element is added in a range of less than 25 percent by weight.

3. An electrode material for forming stamper used as a material of an electrode formed on the surface of a patterned resisit material for electrocasting a stamper material, wherein Ni element is a principal component, and P element is added in a range of less than 25 percent by weight.

4. An electrode material for forming stamper used as a material of an electrode formed on the surface of a patterned resisit material for electrocasting a stamper material, wherein Ni element is a principal component, and Mg element is added in a range of less than 25 percent by weight.

5. An electrode material for forming stamper used as a material of an electrode formed on the surface of a patterned resisit material for electrocasting a stamper material, wherein Ni element is a principal component, and Cr element is added in a range of less than 25 percent by weight.

6. An electrode material for forming stamper used as a material of an electrode formed on the surface of a patterned resisit material for electrocasting a stamper material, wherein Ni element is a principal component, and Au element is added in a range of less than 25 percent by weight.

7. An electrode material for forming stamper used as a material of an electrode formed on the surface of a patterned resisit material for electrocasting a stamper material, wherein Ni element is a principal component, and Si element is added in a range of less than 25 percent by weight.

8. An electrode material for forming stamper used as a material of an electrode formed on the surface of a patterned resisit material for electrocasting a stamper material, wherein Ni element is a principal component, and Ti element is added in a range of less than 50 percent by weight.

9. An electrode material for forming stamper used as a material of an electrode formed on the surface of a patterned resisit material for electrocasting a stamper material, wherein Ni element is a principal component, and Ag element is added in a range of less than 50 percent by weight.

10. A thin film for forming stamper used as an electrode formed on the surface of a patterned resisit material for electrocasting a stamper material, wherein Ni element is a principal component, and Ru element is added in a range of less than 25 percent by weight.

11. A thin film for forming stamper used as an electrode formed on the surface of a patterned resisit material for electrocasting a stamper material, wherein Ni element is a principal component, and Cu element is added in a range of less than 25 percent by weight.

12. A thin film for forming stamper used as an electrode formed on the surface of a patterned resisit material for electrocasting a stamper material, wherein Ni element is a principal component, and P element is added in a range of less than 25 percent by weight.

13. A thin film for forming stamper used as an electrode formed on the surface of a patterned resisit material for electrocasting a stamper material, wherein Ni element is a principal component, and Mg element is added in a range of less than 25 percent by weight.

14. A thin film for forming stamper used as an electrode formed on the surface of a patterned resisit material for electrocasting a stamper material, wherein Ni element is a principal component, and Cr element is added in a range of less than 25 percent by weight.

15. A thin film for forming stamper used as an electrode formed on the surface of a patterned resisit material for electrocasting a stamper material, wherein Ni element is a principal component, and Au element is added in a range of less than 25 percent by weight.

16. A thin film for forming stamper used as an electrode formed on the surface of a patterned resisit material for electrocasting a stamper material, wherein Ni element is a principal component, and Si element is added in a range of less than 25 percent by weight.

17. A thin film for forming stamper used as an electrode formed on the surface of a patterned resisit material for electrocasting a stamper material, wherein Ni element is a principal component, and Ti element is added in a range of less than 50 percent by weight.

18. A thin film for forming stamper used as an electrode formed on the surface of a patterned resisit material for electrocasting a stamper material, wherein Ni element is a principal component, and Ag element is added in a range of less than 50 percent by weight.

* * * * *